United States Patent [19]

Baseggio et al.

[11] 4,359,881

[45] Nov. 23, 1982

[54] DRAWING DEVICE FOR A STRAIGHT KNITTING MACHINE

[75] Inventors: Marcello Baseggio, Ollon; Louis Frund, Monthey, both of Switzerland

[73] Assignee: Atelier de Construction Steiger S.A., Switzerland

[21] Appl. No.: 171,082

[22] Filed: Jul. 22, 1980

[30] Foreign Application Priority Data

Sep. 25, 1979 [CH] Switzerland ..... 8629/79

[51] Int. Cl.[3] ..... D04B 15/88

[52] U.S. Cl. ..... 66/149 R; 66/152

[58] Field of Search ..... 66/149, 150, 152

[56] References Cited

U.S. PATENT DOCUMENTS

| | | | |
|---|---|---|---|
| 2,916,899 | 12/1959 | Hepp et al. | 66/149 R |
| 2,941,387 | 6/1960 | Trumpio | 66/149 X |
| 3,760,609 | 9/1973 | Poocza et al. | 66/149 R |
| 3,955,604 | 5/1976 | Braun | 66/149 R |
| 4,028,912 | 6/1977 | Schneck | 66/149 R |

FOREIGN PATENT DOCUMENTS

| | | | |
|---|---|---|---|
| 518538 | 2/1931 | Fed. Rep. of Germany | 66/152 |
| 2648612 | 5/1978 | Fed. Rep. of Germany | 66/152 |

*Primary Examiner*—Ronald Feldbaum

*Attorney, Agent, or Firm*—Kane, Dalsimer, Kane, Sullivan and Kurucz

[57] ABSTRACT

A drawing device for a straight knitting machine comprises two belts capable of being continuously driven in opposite directions by respective drive shafts over two pulleys of small diameter. The pulleys are located in the area in which the stitches are formed and extend over the entire useful length of the needle rows of the knitting machine. The pulleys and thereby the belts are supported by pivoting frames and the belts are pressed one against the other by the rotation of their drive shafts. In use, knitting is drawn gently and continuously, with the possibility of sliding, between the belts, as the stitches are formed and quite close to the area in which these stitches are formed.

5 Claims, 2 Drawing Figures

DRAWING DEVICE FOR A STRAIGHT KNITTING MACHINE

The present invention relates to a drawing device for a straight knitting machine.

In order to draw out the knitted article as it is formed, straight knitting machines generally use a roller arrangement constituted by two rollers between which the knitted article is gripped, which roller arrangement is located at a certain distance below the needle rows.

Owing to the particular structure and elasticity of the knitted article, the width of the latter decreases rapidly from the needles downwards, i.e. towards the roller arrangement. The result of this is that vertical traction or drawing is not uniform over the entire width of the knitted article. Quite on the contrary, drawing, i.e. the vertical component of the traction decreases considerably and even sometimes approaches zero in the marginal parts of the knitted article, in the knitting area and in order to compensate for this reduction in the drawing action, it is necessary to increase traction in the central area, with a danger of breaking the yarn and needles. This drawback is even more noticeable when increasing, for example when knitting shaped panels or collars. When knitting collars, the drawing effect at the points of the collar is zero.

On the other hand, the drawing action is carried out step-by-step and in jerks, after each passage of the carriage. During knitting proper, there is no drawing action, whereas the ideal would be to draw out each stitch one after the other as soon as it is formed. In addition, the step-by-step drive requires a control mechanism synchronised with the movement of the carriage.

In Swiss Pat. No. 606.569, it has already been proposed using and with some success an auxiliary roller arrangement, close to the needle rows, in order to exert a special drawing action on parts of the knitting such as collars or plastic parts such as knee-pieces. In principle, this roller arrangement operates like a main roller arrangement and requires a mechanism constituted by cams and levers. Furthermore, the diameter of the rollers of this auxiliary roller arrangement is still relatively high, so that the bulk of this auxiliary roller arrangement does not make it possible to locate the latter close to the region in which the stitches are formed.

Now it has already been considered replacing traditional roller arrangements by belts. An apparatus of this type is described in U.K. Pat. No. 1,243,661. This apparatus comprises at least one pair of belts driven in opposite directions by drums and passing over pulleys formed by the ends of two vertical plates pivoted on supports, themselves pivoted and supporting springs acting on the plates in order to push them one against the other, which had the effect of gripping the knitting between the belts. These belts are driven intermittently like traditional roller arrangements. In order to obtain different tensions at the centre and at the ends of the knitting, it is provided to use several pairs of belts driven at different speeds. Additionally, the pressure of the belts may be varied by inclining the movable supports supporting the pressing springs to a greater or lesser extent.

According to the present invention there is provided a drawing device for a straight knitting machine comprising one or a plurality of needle rows which device is intended to extend over the entire useful length of the or each row and comprises two endless belts capable of being continuously driven in opposite directions by respective horizontal shafts and over respective pulleys which are intended to be located in the vicinity of the area in the machine in which the stitches are formed, the pulleys being mounted on frames supported by the shafts for driving the belts, and the shafts being disposed so that the belts tend to press one against the other.

In the present invention the drawing action is no longer carried out jerkily, but continuously during the movement of the carriage and in the immediate vicinity of the area in which the stitches are formed. The stitches are henceforth drawn out as they are formed. Continuous drawing of this type is possible owing to the use of belts which are able to slide on the knitted panel when the traction on the stitches exceeds a certain value.

The drawing action takes place by friction/sliding so that the apparatus is self-regulating and so that it is possible to dispense with any auxiliary regulating means, with the exception of the possibility of varying the speed of rotation of the belts. This drawing action by friction/sliding provides a drawing reserve. In fact, if the slipping ceases, the knitting is entrained more quickly by friction without slipping.

The drawing takes place gently and with extreme flexibility, the recovery between two drops is better and picking up stitches is facilitated since the yarn may be drawn upwards. Since the needles are under much less stress, wear on the latter is reduced.

This result is also obtained with simpler means than in prior apparatus.

Conclusive tests have been carried out with smooth belts but belts could also have a varying roughness or could be ridged.

The present invention will now be described by way of example with reference to the accompanying drawings, in which.

Figure 1:
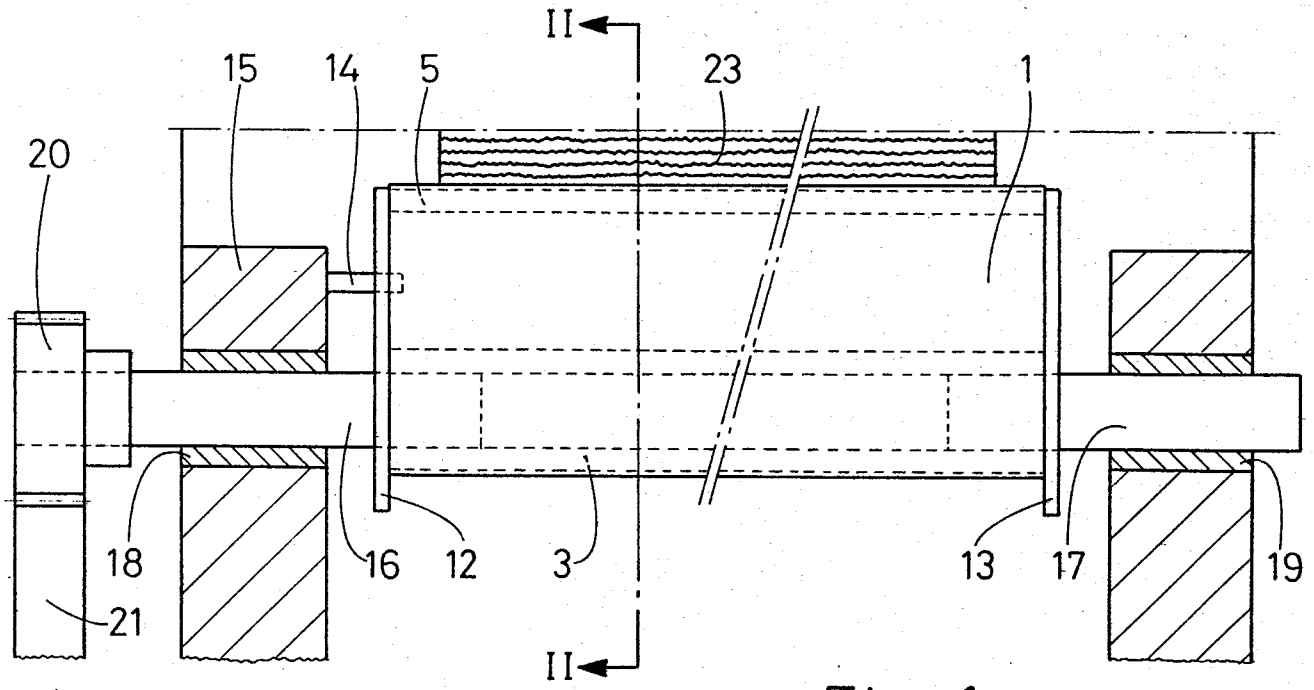
FIG. 1 is a front elevational view of a drawing device, according to the present invention shown without needle rows.
Figure 2:
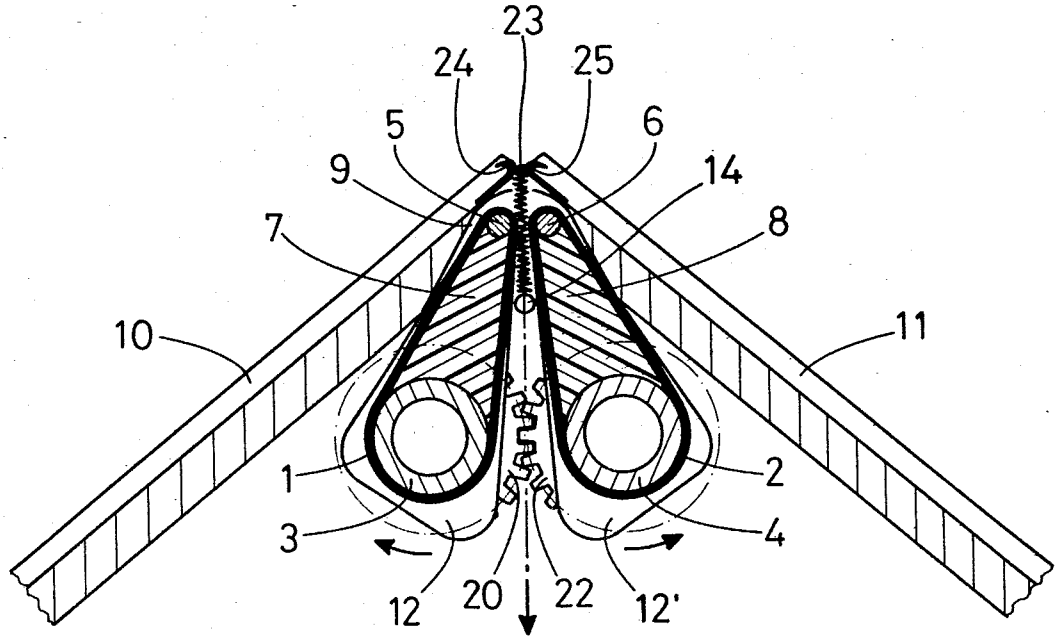
FIG. 2 is a view in elevation and in section on line II—II of FIG. 1 and including the needle rows.

The device essentially comprises two endless belts 1 and 2, of smooth rubber or similar material, which are driven by two tubular drums 3 and 4 over two pulleys 5 and 6 constituted by simple cylindrical metal bars of small diameter, for example between 4 and 5 mm. Disposed between each of the drums 3 and 4 and pulleys 5 and 6 is a frame 7, 8 respectively constituted by a prismatic block extending over the entire length of the drums and including one groove of cylindrical surface by which it is supported whilst sliding on the drum 3, 4 respectively and a second groove serving as a bearing for the pulleys 5 and 6. Laterally, the two blocks 7 and 8 have two flat sides serving as a guide for the rectilinear travel of the belts. The blocks 7 and 8 are preferably made from a self-lubricating synthetic material such as DUROGLISS (Registered Trade Mark), but could also be made from metal, for example from bronze or an aluminium alloy. The blocks 7 and 8 simultaneously ensure the tension of the belts. They are assembled very easily: after having introduced the drum 3 and the pulley 5 into the belt, the block is introduced by forcing it slightly in order to ensure the necessary tension on the belt.

A recess 9 is provided in the upper part of the needle rows 10 and 11 in order to facilitate the passage of the belts.

A cheek 12 respectively 13 is fixed by means of two screws to each of the ends of the frame 7. The first objective of these cheeks is to retain the belt 1 laterally and the retain the pulley 5 axially. Identical cheeks are fixed to the ends of the frame 8. The second objective of the cheeks is to co-operate with a centring pin 14 fixed to the frame 15 of the knitting machine, as will be described hereafter.

The drum 3 is fixed to two shafts 16 and 17, by driving and welding or any other means, mounted in bearings 18 and 19 in the frame of the machine. The shaft 16 supports a pinion 20 meshing with a toothed drive wheel 21. The drum 4 is mounted in an identical manner and supports a pinion 22 meshing with the pinion 20.

The apparatus operates in the following manner: when the knitting 23 is engaged between the belts 1 and 2, directly below the area in which the stitches are formed by the needles 24 and 25, the drums for the belts are driven in the direction of the arrows. The result of this rotation is not only to drive the belts, but also to drive the frames 7 and 8 in this rotary movement, so that they tend to press one against the other, with their belt, thus gripping the knitting 23 which is thus moved downwards by friction and sliding. Since it is not possible to achieve perfect equilibrium of the forces of the two frames, these frames are kept in the centred position by the centering pin 14 against which one or other of the cheeks 12 or 12' abuts. The diameter of the pin 14 is such that it does not hinder the gripping of the knitting 23, but that it prevents one of the belts from being pushed against the needle row by the other belt. In order to eliminate gripping of the knitting by the belts, it is sufficient to stop the rotation of the pinion 20. Since the torque pressing the belts one against the other ceases, the belts tend to separate automatically from each other.

The pressure of the belts one against the other may possibly be modified by varying the speed of rotation, but in general this will not be necessary in view of the fact that the knitting is driven by friction and sliding with a relatively low force. It is precisely this low traction with the possibility of sliding which makes it possible to undertake continuous drawing of the knitting, i.e. even during the formation of stitches and when stitches are being picked up, since the yarn is able to be drawn rearwards and upwards, by drawing the knitting which slides on the belts, without any risk of breakage.

Numerous variations are possible without diverging from the scope of the invention. For example, the frames, i.e. the belts could be pressed one against the other by springs. The blocks 7 and 8 which act as means for tensioning the belts could be made in two parts, one supporting the driving drum and the other the pulley, these two parts being separated by resilient means, for example by springs subject to compression or by a rubber band.

What is claimed is:

1. A drawing device for a straight knitting machine with a plurality of needle rows on which a knitted fabric is formed comprising:

a fixed support means;

two belt assemblies disposed on said support means with knitted fabric being disposed between said assemblies, each assembly comprising:

a shaft, coupled to driving means;

a frame movably disposed in said shaft;

a small pulley movably disposed on said frame in close proximity to said needle rows; and a belt disposed around said shaft, frame and pulley, said belt being driven by said shaft;

said belts being driven in opposite direction and adapted to draw said knitted fabric wherein said pulleys are provided solely to assure pressure on said fabric.

2. A drawing device as claimed in claim 1, in which each frame comprises a prismatic member which is supported on its respective shaft and defines a housing serving as a bearing for the respective pulley, which itself comprises a cylindrical bar.

3. A drawing device as claimed in claim 2, in which said prismatic member is made of a self-lubricating synthetic material.

4. A drawing device as claimed in claim 2, in which the prismatic members define cheeks at their ends for retaining their respective belts and pulleys laterally, the device also comprising a stationary centring pin engaging between the cheeks and parallel to the shafts.

5. A drawing device as claimed in claim 1, in which each frame comprises two prismatic members which are spaced apart by resilient means, one of these members being supported on the drive shaft and the other defining a housing which serves as a bearing for the respective pulley.

* * * * *